US005617801A

United States Patent [19]

Hauser et al.

[11] Patent Number: 5,617,801

[45] Date of Patent: Apr. 8, 1997

[54] COOLED GRATE BLOCK

[75] Inventors: Rolf Hauser, Gruningen; Daniel Morant, Dinhard, both of Switzerland

[73] Assignee: Von Roll Umwelttechnik AG, Zurich, Switzerland

[21] Appl. No.: 560,019

[22] Filed: Nov. 17, 1995

[30] Foreign Application Priority Data

Nov. 17, 1994 [CH] Switzerland ..... 0345294

[51] Int. Cl.[6] ..... F23H 7/08

[52] U.S. Cl. ..... 110/282

[58] Field of Search ..... 110/281, 282, 110/283, 284, 289, 290, 291

[56] References Cited

U.S. PATENT DOCUMENTS

| | | | |
|---|---|---|---|
| 2,171,848 | 9/1939 | Hofft | 122/374 |
| 5,235,921 | 8/1993 | Dunham | 110/282 |

FOREIGN PATENT DOCUMENTS

| | | |
|---|---|---|
| 0621449 | 10/1994 | European Pat. Off. . |
| 230498 | 8/1909 | Germany . |
| 624892 | 1/1936 | Germany . |
| 808263 | 7/1951 | Germany . |
| 498538 | 5/1990 | Germany . |
| 9309198 | 9/1993 | Germany . |
| 4400992 | 5/1995 | Germany . |
| 2143932 | 2/1985 | United Kingdom . |

*Primary Examiner*—Noah P. Kamen
*Attorney, Agent, or Firm*—Oblon, Spivak, McClelland, Maier & Neustadt, P.C.

[57] ABSTRACT

To cool a grate block which forms a part of a grate for plants for the thermal treatment of waste material, a closed cooling space in the grate block below an upper wall supporting the waste material is filled with cooling water. Water feed lines and water drainage lines pass through the cooling space, end in the cooling space, and respectively have a plurality of outlet and inlet openings, so that, in addition to an effective cooling which greatly reduces the temperatures, an optimum distribution of cold water and hot water also takes place in the cooling space. Since thermal expansions in the material are dispensed with, only a few screwed-together grate blocks can form a grate-block row. The assembly and exchange of grate blocks are simpler and an undesired amount dropping through the grate between the grate blocks is eliminated to a great extent. Moreover, the grate blocks can be produced from a less high-alloy material.

12 Claims, 2 Drawing Sheets

COOLED GRATE BLOCK

BACKGROUND OF THE INVENTION

1. Field of the Invention

The present invention relates to a cooled grate block which forms a part of a grate for a plant for the thermal treatment of waste material.

2. Discussion of the Background

In related waste incineration plants, it is known that the waste material is conveyed on a grate through a combustion chamber and, during this process, it is dried and burnt. In addition to the transporting function, the grate also ensures constant thorough mixing of the waste material so that new surfaces of the waste material are subjected again and again to thermal treatment in the combustion chamber. For this purpose, a grate path has a plurality of grate-block rows arranged one after the other in the manner of steps, in each case fixed and movable grate-block rows following on from one another alternately. The waste material, for example refuse, located on the grate is pushed forward by a translatory movement of the movable grate-block rows and, at the same time, is thoroughly mixed. A grate-block row is formed in each case by a plurality of, generally 16 to 24, grate blocks which are suspended adjacently on a holding pipe and are braced with one another by means of a tension rod. The individual grate blocks are cooled by means of air flowing through which, at the same time, serves in combustion grates as an oxidation medium which is necessary for combustion.

Despite the air-cooling, the grate blocks are subjected to high thermal loading which results in great thermal stresses in the material of the grate blocks. Cracks may occur in the material, thus causing the risk of corrosion to rise. The grate blocks must be made of high-quality material, for example of high-alloy steel. Owing to the large thermal expansions, the size of the individual grate blocks is limited; a relatively large number of grate blocks is required in one grate-block row. It is disadvantageous in this case that certain portions of the waste material to be incinerated (bright metals, dust, etc.) drop through the gaps between the individual grate blocks, which gaps are formed by repeated expansion and contraction due to different block temperatures caused by the combustion sequence and the start up and shut down of the furnace, which portions of waste material then pass into the slag without having been burnt. If two or three grate paths are used next to one another, holders for the tension rods and seals for the leaking air must be arranged not only on the outer side of such a grate, but also between the grate paths. The exchange of individual grate blocks is thus complicated and requires long service times.

SUMMARY OF THE INVENTION

An object of the present invention is to reduce the thermal loading of the grate block and allow a construction of a grate which is simpler in terms of assembly and maintenance, but nevertheless is also more capable of withstanding all the operational requirements.

The advantages achieved by the present invention are to be seen, in particular, in the effective cooling, as a result of which thermal stresses and thermal expansions in the grate block are eliminated to a great extent. Thus only a few, relatively wide grate blocks—joined together in a simple manner—can form a grate-block row. As a result, not only does the assembly and exchange become simpler, but the amount of material dropping through the grate can also be reduced considerably. In this case, the grate block can also be made of lower-quality material.

Further particular advantages result when using the grate blocks according to the invention for a pyrolysis grate, which is used in the method according to the Swiss Patent Application No. 01510/94-8 (A 10364 CH). In this method, no air is passed through the grate as an oxidation medium; since, according to the invention, the air is likewise not present as a cooling medium, the grate blocks do not have to have air openings which are subject to the risk of blockage.

Thus, the present invention relates to a cooled grate block which is part of a grate for a plant for a thermal treatment of waste material. The cooled grate block comprises an upper wall having an outer surface which forms a useful surface on which the waste material to be treated comes to rest and along which the waste material is transported. The upper wall bounds a cooling space which is located below the upper wall through which a water feed line and a water drainage line pass. The water feed line and the water drainage line end in the cooling space and have a plurality of outlet opens and a plurality of inlet openings respectively.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
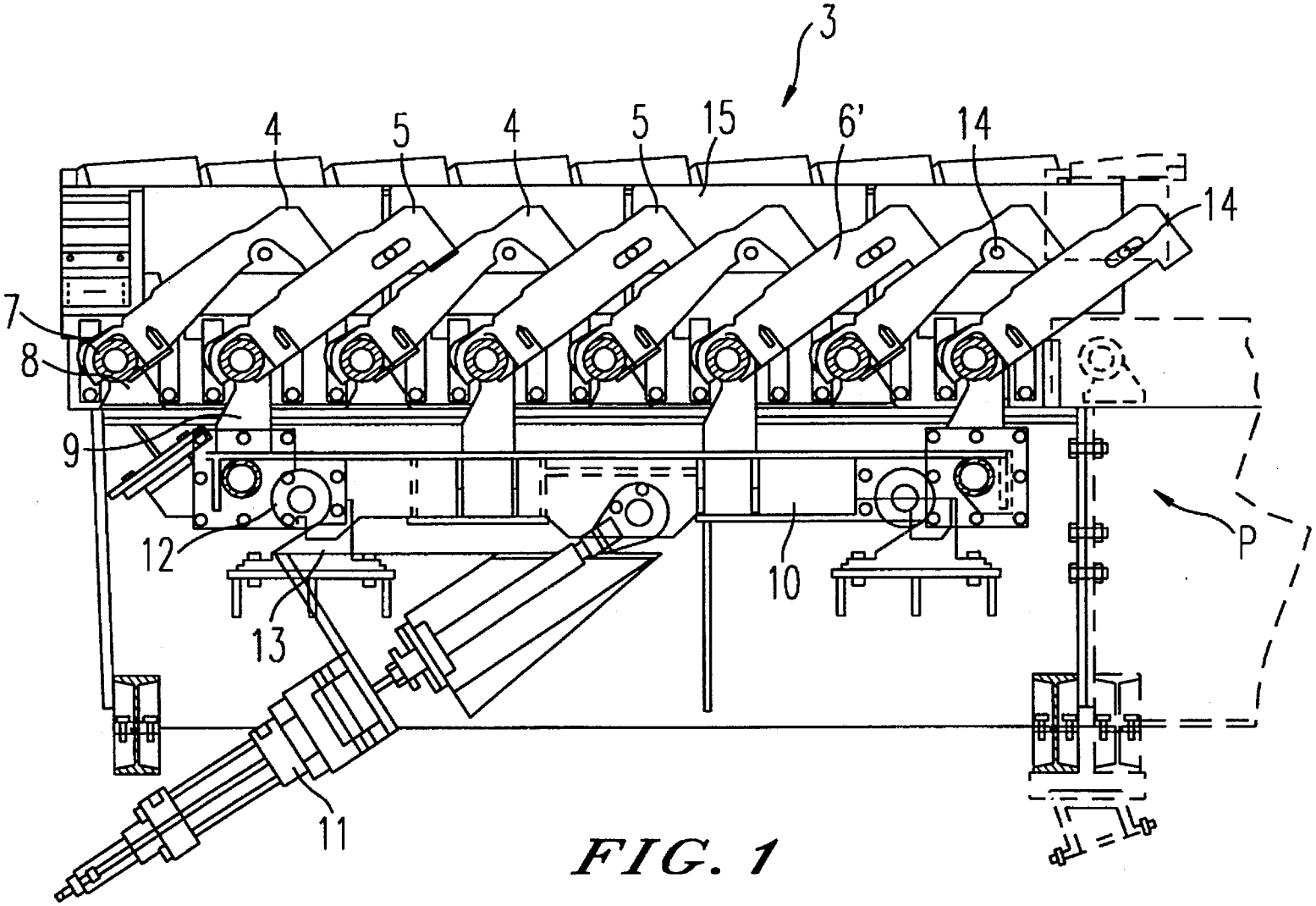
FIG. 1 shows an exemplary embodiment of a grate element as part of a grate according to the related art.

Referring now to the drawings, wherein like reference numerals designate identical or corresponding parts throughout the several views, FIG. 1 illustrates a grate element 3 as part of a grate for a plant for the thermal treatment of waste material. An inclined grate path is composed in length of a plurality of grate elements 3; generally three to five grate elements 3 are arranged one behind the other. Additionally, a plurality of grate paths can be mounted next to one another; usually one to four grate paths form the width of the grate. The number of grate elements 3 and grate paths depends on the specified throughput volume of the waste material and of its calorific value.

Each grate element 3 has a plurality of, possibly eight, grate-block rows 4, 5 arranged one behind the other, in each case a movable grate-block row 5 following on from a fixed grate-block row 4. In each grate-block row 4, 5, a plurality of grate blocks 6 are arranged next to one another. Up to now, it has been customary to place 16 to 24 air-cooled grate blocks 6' next to one another in a grate-block row 4, 5. As shown in FIG. 1, they were suspended on a block holding tube 7 and braced by means of tension rods 14 and turnbuckle sleeves (not illustrated). According to the invention, only three to four water-cooled grate blocks 6, suspended on a block holding tube 7, of a grate-block row 4, 5 are now joined, for example screwed, fixedly together. A side panel 15 is screwed onto the outermost block of each fixed block row.

The block holding tubes 7 of the fixed grate-block rows 4 are supported according to FIG. 1 by stationary brackets 8. The block holding tubes 7 of the movable grate-block rows 5 are attached in brackets 9 which are assigned to a movable grate carriage 10. Each grate element 3 is fitted with such a grate carriage 10. The grate carriage 10 is driven by means of two hydraulic cylinders 11 arranged in parallel and is moved back and forth by means of rollers 12 on running surfaces 13. The movable grate-block rows 5 are thus also moved, which exert a thrusting and shearing effect on the waste material located on the grate path 2 so that new surfaces of the waste material are subjected again and again to the thermal treatment in the combustion chamber with simultaneous forward conveying of the waste material.

Figure 2:
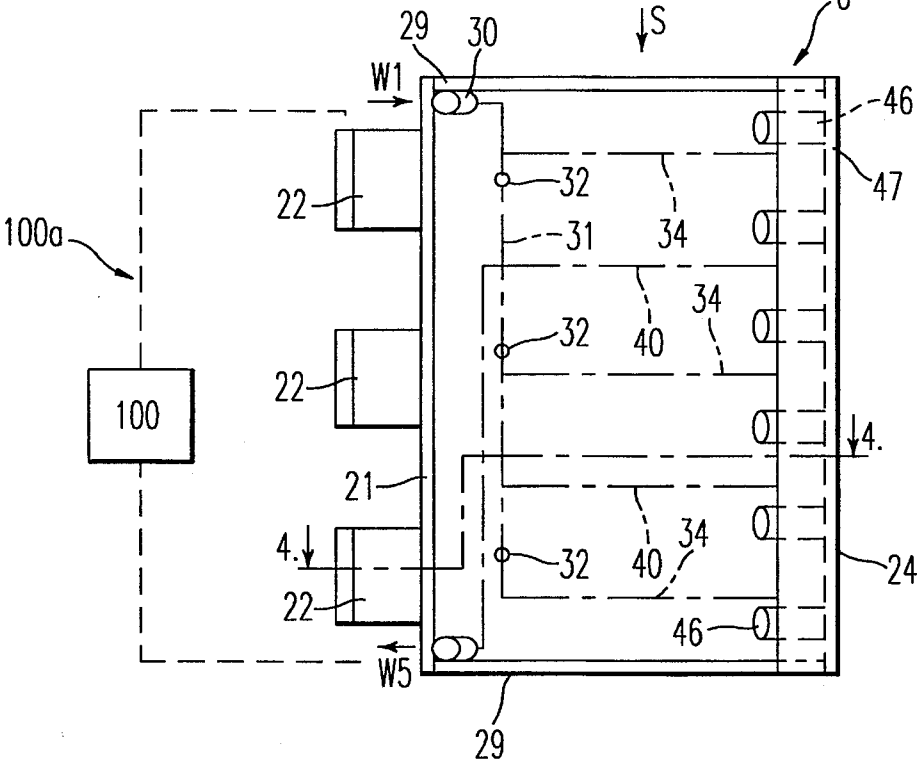
FIG. 2 shows an exemplary embodiment, illustrated schematically, of a grate block according to the invention, as seen from below in the direction of the arrow P according to FIG. 1.

An exemplary embodiment of a grate block 6 according to the invention, provided for a combustion grate, is now described below with reference to FIGS. 2 to 4.

Figure 3:
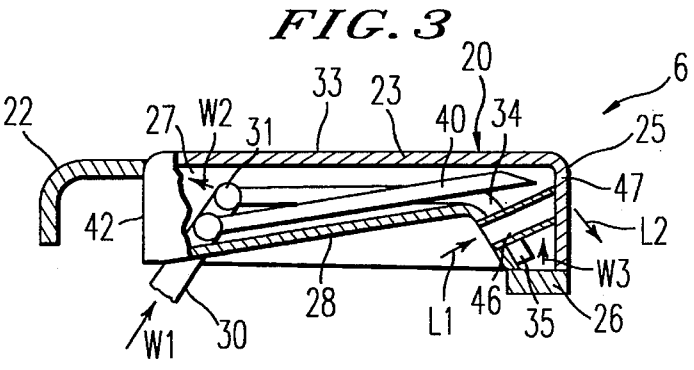
FIG. 3 shows a side view of the grate block in the direction of the arrow S according to FIG. 2, partially in section.
Figure 4:
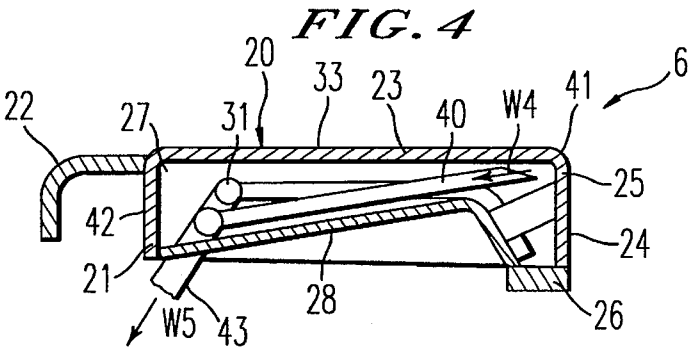
FIG. 4 shows a section along the line IV—IV in FIG. 2.

The grate block 6 has a block body 20 of U-shaped cross-section, whose upper wall is denoted by 23 in FIGS. 3 and 4. The outer surface of the upper wall 23 forms a useful surface 33 on which the waste material to be treated comes to rest and along which it is transported. A rear wall 21 of the block body 20 is provided with a hook 22 for suspension on the block holding tube 7 (FIG. 1). There is a corner 25 between the upper wall 23 and a front wall 24. At the bottom, the grate block 6 is provided with a sloping bottom 28 and a foot 26. In this case, the foot 26 of a grate block 6 is assigned respectively to the upper wall 23 of a following grate block 6; they are in each case to some extent displaceable relative to one another.

An inner cooling space 27 is surrounded by the block body 20, the bottom 28 and the foot 26 and two side walls 29. A water feed line 30 opens out into the cooling space 27. The water supply is denoted by an arrow W1 in FIG. 3. Extending parallel to the rear wall 21 is a transverse water feed line 31 which is connected to the water feed line 30 and is provided with outlet openings 32 at some places (three illustrated in FIG. 2). This water outlet is denoted by an arrow W2 in FIG. 3. Branching off from the transverse water feed line 31 are a plurality of, possibly three, longitudinally arranged water feed branch lines 34 which extend right up to the front wall 24 and are bent there in such a way that their outlet opening 35 is located directly in front of the foot 26. The water flowing out of the outlet opening 35, together with the water (arrow W2) emerging from the outlet openings 32, fills, in the direction of an arrow W3, the closed cooling space 27, these two water flows opposing one another to a certain extent and ensuring a good thorough mixing of the water and an enhanced cooling effect. In this case, it is significant that the place on the grate block 6, which is subject, in particular, to great mechanical loading, namely the foot 26, is acted upon directly by the cooling water.

The front corner 25 is subjected to the highest temperatures and therefore to the greatest thermal loading (cf. particularly FIG. 1, from which it can readily be imagined which region of the grate blocks is constantly subjected to the direct thermal loading or the direct contact with the layer of waste material, irrespective of the relative position in which the movable and fixed grate-block rows 4, 5 are momentarily situated). The lighter water which has already been heated rises to this place in the cooling space 27 and continues to be heated there additionally. Inlet openings 41 (FIG. 4) of a plurality of, possibly two, water drainage branch lines 40 (cf. FIG. 2) are formed directly in this region. The entry of heated water into the water drainage branch lines 40 is denoted by an arrow W4 in FIG. 4. The water drainage branch lines 40 extend obliquely along the bottom 28 and open out into a transverse water drainage line 42 which is arranged parallel to the transverse water feed line 31 and is offset to be lower relative to the latter. From there, the heated water is conducted away out of the cooling space 27 in the direction of an arrow W5 (FIG. 4) by means of a drainage line 43.

The expedient arrangement of the cold water supply (outlet openings 35) and the hot water drainage (inlet openings 41) ensures the optimum cooling flow (this also prevents, for example, so-called "water pockets" with non-circulating water forming at particular places or steam bubbles occurring in the region of the corner 25), does not cause a strain on the mechanically loaded foot 26 and avoids excessively high thermal stresses in the region of the front corner 25.

The water feed line 30 and the water drainage line 43 are connected, in a manner which is not illustrated in greater detail, to a cold water low-pressure system. A connection to a closed cooling water system 100 with a built-in heat exchanger 100 is to be preferred.

In the embodiment of the grate block 6 illustrated in FIGS. 2 to 4 and provided for a combustion grate, air as an oxidation medium which is necessary for the combustion is fed from below in the direction of an arrow L1 (FIG. 3) through a plurality of tubes 46 distributed evenly along the width of the grate block and extending through the cooling space 27 between the bottom 28 and the front wall 24. According to FIG. 3, the front wall 24 has a plurality of air outlet openings 47 which are assigned to the tubes 46 and out of which the combustion air flows in the direction of an arrow L2. Since the air is used solely as a combustion medium but not as a cooling medium as previously, far fewer air outlet openings 47, which have to be cleaned painstakingly due to blockage, are required than has been customary up to now.

If the water-cooled grate blocks 6 according to the invention are used for a pyrolysis grate, in which no air is passed through the grate as an oxidation medium, the tubes 46 and the air outlet openings 47 which are subject to the risk of blockage are not required at all. Since no air has to be conducted through the grate 1, a thicker layer of waste material can be applied to the grate 1.

In a combustion grate, the first grate element 3, which is intended for the rapid ignition by start-up burners, can likewise comprise grate blocks 6 without tubes 46 and air outlet openings 47 since the water now provides the cooling instead of the air.

In the water-cooling of individual grate blocks 6, according to the invention, the mean temperature values on the grate can be reduced substantially by virtue of the more favorable heat transmission coefficients of water compared to air. If these values varied between about 350° to 700° C. for air-cooling, they could be reduced to about 50° to 100° C. due to the water-cooling. The high thermally caused stresses and expansions in the material which were customary in air-cooled grate blocks 6' are not applicable in the water-cooling according to the invention. As a result, in contrast to earlier grate designs, fewer (three to four), relatively wide grate blocks 6 can be arranged next to one another without difficulty in a grate-block row 4, 5 and form the width of the grate path 2. The previous bracing by means of tension rods 14 (FIG. 1) is likewise dispensed with; the grate blocks 6 of a grate-block row 4 or 5 can be screwed together in a simple manner. In the case of multi-path grates, the previously required holders for the tension rods between the individual paths are thus also not required. As a result, any change of grate blocks 6 required is simplified substantially and requires shorter service times. Moreover, the exchange was required more frequently, for example annually, at the earlier high temperatures. A substantial advantage according to the invention also lies in the fact that the amount of material dropping through the grate is reduced considerably due to the use of few grate blocks 6 or the omission of gaps; the risk that, for example, bright metals or dust drop through the grate and pass into the slag without having been burnt is significantly lower.

Owing to the lower temperatures and the lower thermal loading of the grate block 6, the risk is also eliminated to a great extent that, due to thermal stresses, cracks occur in the material which enhance corrosion. The use of lower-quality material for the grate blocks 6 can thus be considered.

Both the fixed and the movable grate-block rows 4 and 5 are preferably composed of water-cooled grate blocks 6. However, it would also be possible to combine the water-cooling and the air-cooling with one another.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cooled grate block which is part of a grate for a plant for a thermal treatment of waste material, the cooled grate block comprising:

an upper wall having an outer surface which forms a useful surface on which the waste material to be treated comes to rest and along which the waste material is transported, wherein the upper wall bounds a cooling space which is located below the upper wall through which a water feed line and a water drainage line pass, the water feed line and the water drainage line ending in the cooling space and respectively having a plurality of outlet openings and a plurality of inlet openings.

2. A cooled grate block according to claim 1, wherein:

the cooling space is formed in a U-shaped block body and is closed at a side by two side walls and from below by a bottom and a foot, the foot of the grate block being assigned respectively to an upper wall of a downstream grate block so as to be relatively displaceable.

3. A cooled grate block according to claim 2, wherein:

the outlet openings of the water feed line are arranged in a region of the foot.

4. A cooled grate block according to claim 2, wherein:

the inlet openings of the water drainage line are arranged in a region of a corner formed at a transition of the upper wall to a front wall.

5. A cooled grate block according to claim 2, wherein:

the water feed line has a transverse line which is arranged parallel to a rear wall of the block body and to which a plurality of branch lines are connected, which protrude right into a front region of the cooling space and are provided with the outlet openings.

6. A cooled grate block according to claim 5, wherein:

the transverse line of the water feed line is provided with a plurality of additional water outlet openings.

7. A cooled grate block according to claim 2, wherein:

the water drainage line has a transverse line which is arranged parallel to a rear wall of the block body and to which a plurality of branch lines are connected, which protrude right into a front region of the cooling space and are provided with the inlet openings.

8. A cooled grate block according to claim 2, wherein the cooled grate block forms a part of a combustion grate of a waste incineration plant, and a front wall of the block body is provided with a plurality of air outlet openings which are distributed evenly over a width of the grate block and to which the air is supplied as a combustion medium through corresponding tubes which pass through the cooling space between the bottom and the front wall.

9. A cooled grate block according to claim 1, wherein:

the water feed line and the water drainage line are connected to a closed cooling water system provided with a heat exchanger.

10. A grate made up of the cooled grate blocks according to claim 1, wherein a plurality of the grate blocks are connected to a block holding tube and joined together to form a grate-block row, the grate-block row being formed from a maximum of four of the grate blocks.

11. A grate according to claim 10, wherein side walls of the adjacent grate blocks are screwed together.

12. A grate according to claim 10, comprising a plurality of fixed grate-block rows and a plurality of movable grate-block rows which are arranged following on from one another alternately, wherein both the fixed grate-block rows and the movable grate-block rows are formed by the water-cooled grate blocks.

* * * * *